US010553163B2

(12) United States Patent
Chung et al.

(10) Patent No.: US 10,553,163 B2
(45) Date of Patent: Feb. 4, 2020

(54) SCAN DRIVER AND DISPLAY APPARATUS HAVING THE SAME

(71) Applicant: Samsung Display Co., Ltd., Yongin-si, Gyeonggi-do (KR)

(72) Inventors: Kyunghoon Chung, Yongin-si (KR); Hyunjoon Kim, Suwon-si (KR); Kyung-Bae Kim, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/949,363

(22) Filed: Apr. 10, 2018

(65) Prior Publication Data

US 2018/0357965 A1 Dec. 13, 2018

(30) Foreign Application Priority Data

Jun. 13, 2017 (KR) ..... 10-2017-0073875

(51) Int. Cl.
*G09G 3/32* (2016.01)
*G09G 3/3266* (2016.01)

(52) U.S. Cl.
CPC ..... *G09G 3/3266* (2013.01); *G09G 2310/06* (2013.01); *G09G 2310/08* (2013.01)

(58) Field of Classification Search
None
See application file for complete search history.

(56) References Cited

U.S. PATENT DOCUMENTS

2017/0032752 A1* 2/2017 Huang ..... G09G 3/3648

FOREIGN PATENT DOCUMENTS

| | | | |
|---|---|---|---|
| KR | 10-2007-0022550 | A | 2/2007 |
| KR | 10-2014-0025149 | A | 3/2014 |
| KR | 10-2016-0003364 | A | 1/2016 |
| KR | 10-2016-0089560 | A | 7/2016 |

* cited by examiner

*Primary Examiner* — Joseph R Haley
(74) *Attorney, Agent, or Firm* — Lewis Roca Rothgerber Christie LLP

(57) ABSTRACT

A scan driver includes circuit stages for sequentially outputting scan signals, each one of the circuit stages including a signal generator for generating signals provided at a first node and a third node based on a carry signal and a second clock signal, the signal generator including a (2-1)-th transistor including a control electrode connected to the third node and a first electrode for receiving the second clock signal, and a (2-2)-th transistor including a control electrode for receiving a low driving voltage, a first electrode connected to a second electrode of the (2-1)-th transistor, and a second electrode connected to the first node, a first node controller for applying a boosting voltage to the first node based on a first clock signal, and a pull up/down circuit for pulling the scan signal up/down to a high/low voltage based on a signal applied to a second node.

20 Claims, 11 Drawing Sheets

<COMPARATIVE EXEMPLARY EMBODIMENT>

<EXEMPLARY EMBODIMENT>

SCAN DRIVER AND DISPLAY APPARATUS HAVING THE SAME

CROSS-REFERENCE TO RELATED APPLICATION

This application claims priority to, and the benefit of, Korean Patent Application No. 10-2017-0073875, filed on Jun. 13, 2017, the entire disclosure of which is hereby incorporated by reference.

BACKGROUND

1. Field

Exemplary embodiments of the inventive concept relate to a scan driver and a display apparatus including the scan driver.

2. Description of the Related Art

Recently, various flat panel display devices that have weight and size advantages over conventional display devices, such as Cathode Ray Tubes (CRTs), have been developed. Examples of the flat panel display devices include liquid crystal display (LCD) devices, field emission display (FED) devices, plasma display panels (PDPs), and organic light emitting display (OLED) devices.

The OLED device has advantages such as a rapid response and low power consumption, because the OLED device uses organic light emitting diodes that emit light based on recombination of electrons and holes.

SUMMARY

Aspects of embodiments of the inventive concept are directed to a scan driver for improving reliability of transistors.

Aspects of embodiments of the inventive concept are directed to a display apparatus including the scan driver.

According to some exemplary embodiments of the inventive concept, there is provided a scan driver including: a plurality of circuit stages configured to sequentially output a plurality of scan signals, each one of the plurality of circuit stages including: a signal generator configured to generate signals provided at a first node and a third node based on a carry signal and a second clock signal, the signal generator including: a (2-1)-th transistor including a control electrode connected to the third node and a first electrode configured to receive the second clock signal; and a (2-2)-th transistor including a control electrode configured to receive a low driving voltage, a first electrode connected to a second electrode of the (2-1)-th transistor, and a second electrode connected to the first node; a first node controller including a second capacitor configured to apply a boosting voltage to the first node based on a first clock signal; a pull up/down circuit configured to pull the scan signal up to a high voltage and down to a low voltage based on a signal applied to a second node; and a holding circuit configured to hold the scan signal at the low driving voltage based on a signal applied to the third node.

In some embodiments, the scan driver further includes: a second node controller configured to control a signal applied to the second node based on the first clock signal and a signal applied to the third node, the second node controller including: a (7-1)-th transistor including a control electrode configured to receive the first clock signal; a (7-2)-th transistor including a control electrode configured to receive the low driving voltage, a first electrode connected to a second electrode of the (7-1)-th transistor, and a second electrode connected to the second node; and a third capacitor configured to apply a boosting voltage to the second node.

In some embodiments, the scan driver further includes: a third node controller configured to control a signal applied to the third node and including a first capacitor configured to apply a boosting voltage to the third node.

In some embodiments, the signal generator further includes: a first transistor including a control electrode configured to receive the second clock signal, a first electrode configured to receive the carry signal, and a second electrode connected to the third node; and a third transistor including a control electrode configured to receive the second clock signal, a first electrode configured to receive the low driving voltage, and a second electrode connected to the first node.

In some embodiments, the first node controller further includes a sixth transistor including a control electrode connected to the first node and a second electrode of the second capacitor, a first electrode configured to receive the first clock signal, and a second electrode connected to a first electrode of the second capacitor.

In some embodiments, the pull up/down circuit includes a ninth transistor including a control electrode connected to the second node, a first electrode configured to receive a scan clock signal, and a second electrode connected to an output terminal.

In some embodiments, the second node controller further includes an eighth transistor including a control electrode connected to the third node, a first electrode configured to receive a scan clock signal, and a second electrode connected to the second node.

In some embodiments, the holding circuit includes a tenth transistor including a control electrode connected to the third node, a first electrode configured to receive the low driving voltage, and a second electrode connected to the output terminal.

In some embodiments, the third node controller includes: a fourth transistor including a control electrode connected to the third node and a second electrode of the first capacitor, a first electrode configured to receive the first clock signal, and a second electrode connected to a fourth node; and a fifth transistor including a control electrode connected to the first node, a first electrode configured to receive a high driving voltage, and a second electrode connected to the fourth node.

In some embodiments, the scan driver further includes: an eleventh transistor including a control electrode configured to receive the scan clock signal, a first electrode configured to receive the carry signal, and a second electrode connected to a first electrode of the first transistor.

According to some exemplary embodiments of the inventive concept, there is provided a display apparatus including: a display panel including a plurality of pixels, each one of the plurality of pixels including at least one N-type transistor and an organic light emitting diode; a scan driver configured to provide the N-type transistor with a scan signal and including a plurality of circuit stages, each one of the plurality of circuit stages including: a signal generator configured to generate signals provided to a first node and a third node based on a carry signal and a second clock signal, the signal generator including: a (2-1)-th transistor including a control electrode connected to the third node and a first electrode configured to receive the second clock signal; and a (2-2)-th transistor including a control electrode configured to receive a low driving voltage, a first electrode connected to a second electrode of the (2-1)-th transistor and a second electrode connected to the first node; a first node controller including a second capacitor configured to apply a boosting voltage to the first node based on a first clock signal; a pull up/down circuit configured to pull the scan signal up to a high voltage and down to a low voltage based on a signal applied to a second node; and a holding circuit configured to hold the scan signal at the low driving voltage based on a signal applied to the third node.

In some embodiments, the one of the plurality of circuit stages further includes: a second node controller configured to control a signal applied to the second node based on the first clock signal and a signal applied to the third node, the second node controller including: a (7-1)-th transistor including a control electrode configured to receive the first clock signal; a (7-2)-th transistor including a control electrode configured to receive the low driving voltage, a first electrode connected to a second electrode of the (7-1)-th transistor, and a second electrode connected to the second node; and a third capacitor configured to apply a boosting voltage to the second node.

In some embodiments, the one of the plurality of circuit stages further includes: a third node controller configured to control a signal applied to the third node and including a first capacitor configured to apply a boosting voltage to the third node.

In some embodiments, the signal generator includes: a first transistor including a control electrode configured to receive the second clock signal, a first electrode configured to receive the carry signal, and a second electrode connected to the third node; and a third transistor including a control electrode configured to receive the second clock signal, a first electrode configured to receive the low driving voltage, and a second electrode connected to the first node.

In some embodiments, the first node controller further includes: a sixth transistor including a control electrode connected to the first node and a second electrode of the second capacitor, a first electrode configured to receive the first clock signal, and a second electrode connected to a first electrode of the second capacitor.

In some embodiments, the pull up/down circuit includes a ninth transistor including a control electrode connected to the second node, a first electrode configured to receive a scan clock signal, and a second electrode connected to an output terminal.

In some embodiments, the second node controller further includes an eighth transistor including a control electrode connected to the third node, a first electrode configured to receive a scan clock signal, and a second electrode connected to the second node.

In some embodiments, the holding circuit includes a tenth transistor including a control electrode connected to the third node, a first electrode configured to receive the low driving voltage, and a second electrode connected to the output terminal.

In some embodiments, the third node controller includes: a fourth transistor including a control electrode connected to the third node and a second electrode of the first capacitor, a first electrode configured to receive the first clock signal, and a second electrode connected to a fourth node; and a fifth transistor including a control electrode connected to the first node, a first electrode configured to receive a high driving voltage, and a second electrode connected to the fourth nod.

In some embodiments, the one of the plurality of circuit stages further includes: an eleventh transistor including a control electrode configured to receive the scan clock signal, a first electrode configured to receive the carry signal, and a second electrode connected to a first electrode of the first transistor.

According to the inventive concept, in the circuit stage of a pixel, the bootstrapping capacitor is connected to a pair of transistors in series, and thus the source/drain voltage of the transistors may decrease and the reliability of the transistors may increase.

BRIEF DESCRIPTION OF THE DRAWINGS

The above and other features and aspects of the inventive concept will become more apparent by describing in detailed exemplary embodiments thereof with reference to the accompanying drawings, in which.

DETAILED DESCRIPTION

Hereinafter, the inventive concept will be explained in detail with reference to the accompanying drawings.

Figure 1:
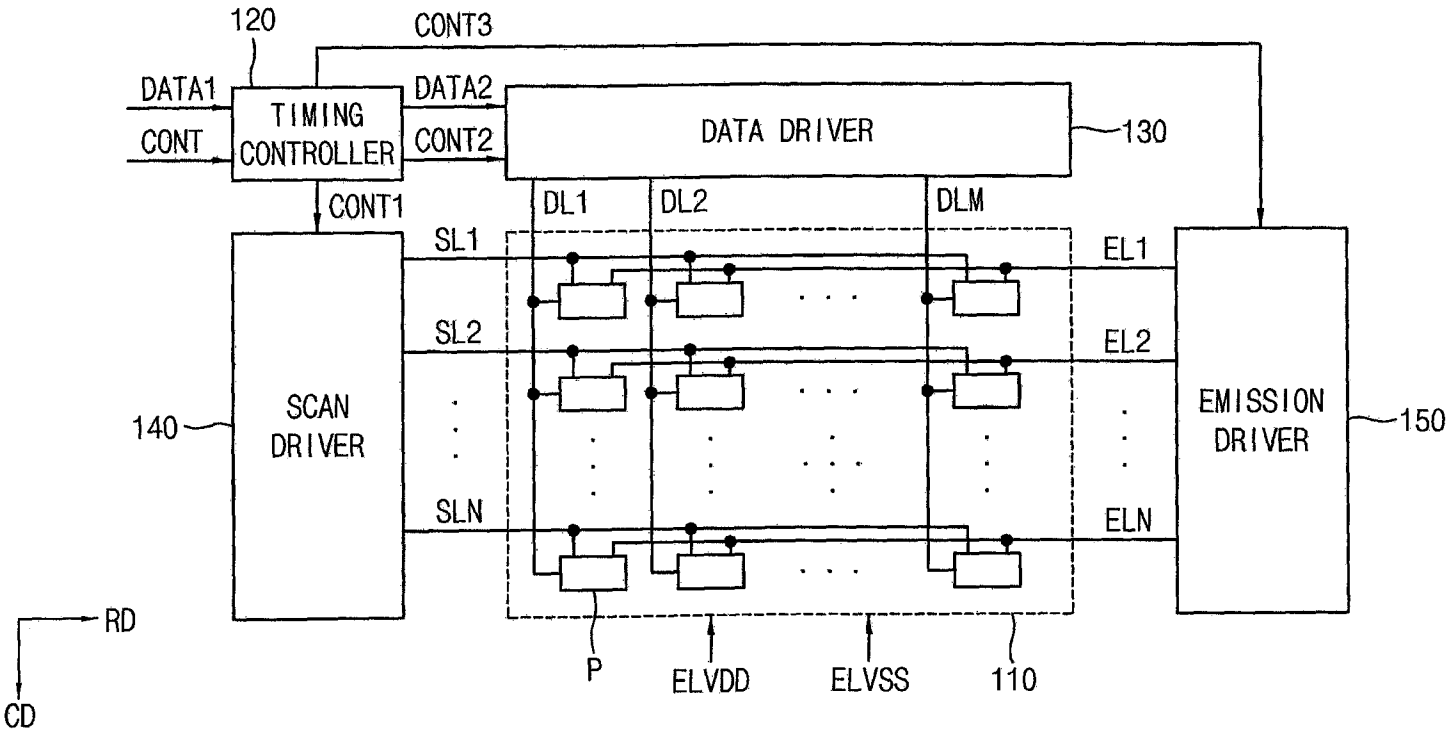
FIG. 1 is a block diagram illustrating a display apparatus according to an exemplary embodiment of the inventive concept.

FIG. 1 is a block diagram illustrating a display apparatus according to an exemplary embodiment of the inventive concept.

Referring to FIG. 1, the display apparatus 100 may include a display panel 110, a timing controller 120, a data driver 130, a scan driver 140, and an emission driver 150.

The display panel 110 may include a plurality of pixels P, a plurality of scan lines SL1, . . . , SLN, a plurality of data lines DL1, . . . , DLM, and a plurality of emission control lines EL1, . . . , ELN (wherein, 'N' and 'M' are natural numbers).

The pixels P may be arranged in the form of a matrix having a plurality of pixel rows and a plurality of pixel columns. Each pixel P may be connected to a scan line SL, a data line DL, and an emission control line EL.

The scan lines SL1, . . . , SLN extend in a row direction RD and are arranged in (e.g., spaced from one another along) a column direction CD. The scan lines SL1, . . . , SLN may be connected to the scan driver 140, which provides scan signals to the pixels P.

The data lines DL1, . . . , DLM extend in the column direction CD and are arranged in the row direction RD. The data lines DL1, . . . , DLM may be connected to the data driver 130, which provides data voltages to the pixels P.

The emission control lines EL1, . . . , ELN extend in the row direction RD and are arranged in column direction CD. The emission control lines EL1, . . . , ELN may be connected to the emission driver 150, which provides emission control signals to the pixels P.

In addition, the pixels P may receive a first emission power source ELVDD and a second emission power source ELVSS.

Each of the pixels P may receive a data voltage in response to one of the scan signals and emit light having a luminance corresponding to the data voltage using the first and second emission power sources ELVDD and ELVSS.

The timing controller 120 may receive an image signal DATA1 and a control signal CONT from an external device. The image signal DATA1 may include color (e.g., red, green, and blue) data. The control signal CONT may include a horizontal synchronization signal, a vertical synchronization signal, a main clock signal, and/or one or more other signals.

The timing controller 120 may convert the image signal DATA1 to image data DATA2 based on a pixel structure, a resolution of the display panel 110, and/or one or more other considerations.

In one embodiment, the timing controller 120 may generate a first control signal CONT1 for driving the scan driver 140, a second control signal CONT2 for driving the data driver 130, and a third control signal CONT3 for driving the emission driver 150 based on the control signal CONT.

The data driver 130 may convert the image data DATA2 to a data voltage based on the second control signal CONT2, and output the data voltage to data lines D1, . . . , DM.

The scan driver 140 may generate scan signals based on the first control signal CONT1. The scan driver 140 may sequentially output the scan signals S1, . . . , SN along the column direction CD. The scan signals may be sequentially outputted to the scan lines SL1, . . . , SLN in the row direction CD. The first control signal CONT1 may include a start control signal FLM, a plurality of clock signals, and a plurality of scan clock signals.

The emission driver 150 may generate emission control signals based on the third control signal CONT3. The emission control signals may be sequentially outputted to the emission control lines EL1, . . . , ELN. For example, in a sequential emission driving mode, the emission driver 150 may sequentially provide the emission control signals with the emission control lines EL1, . . . , ELN. In some example embodiments, in a simultaneous (or concurrent) emission driving mode, the emission driver 150 may concurrently or simultaneously provide the emission control signals to the emission control lines EL1, . . . , ELN.

Figure 2:
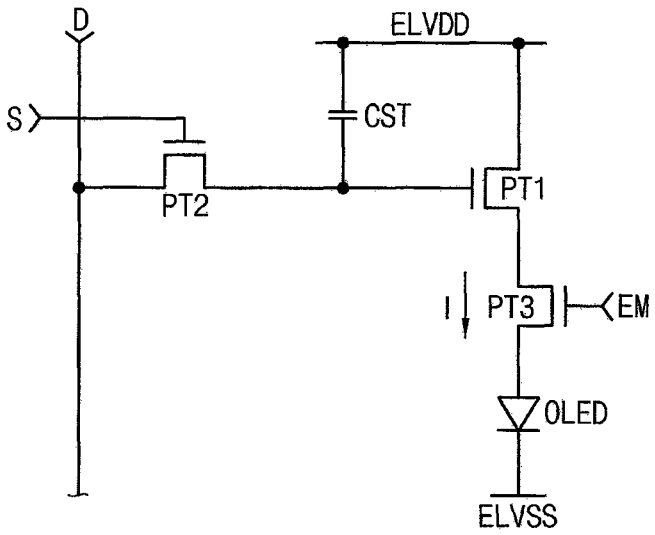
FIG. 2 is a circuit diagram illustrating a pixel circuit according to an exemplary embodiment of the inventive concept.

FIG. 2 is a circuit diagram illustrating a pixel circuit according to an exemplary embodiment of the inventive concept.

According to one exemplary embodiment, the pixel P may include a plurality of pixel transistors and at least one capacitor, and the plurality of pixel transistors may include an N-type transistor and a P-type transistor.

According to one exemplary embodiment, the scan driver 140 may provide the N-type transistor among the plurality of pixel transistors in the pixel P with a scan signal.

Referring to FIGS. 1 and 2, for example, the pixel P may include an organic light emitting diode OLED, a first pixel transistor PT1, a capacitor CST, a second pixel transistor PT2, and a third pixel transistor PT3.

The first pixel transistor PT1 may include a control electrode connected to the second pixel transistor PT2, a first electrode receiving the first emission power source ELVDD, and a second electrode connected to the third pixel transistor PT3.

The capacitor CST may include a first electrode receiving the first emission power source ELVDD and a second electrode connected to a control electrode of the first pixel transistor PT1.

The second pixel transistor PT2 may include a control electrode receiving a scan signal S, a first electrode receiving a data voltage D, and a second electrode connected to a control electrode of the first pixel transistor PT1.

The third pixel transistor PT3 may include a control electrode receiving an emission control signal EM, a first electrode connected to a second electrode of the first pixel transistor PT1, and a second electrode connected to the organic light emitting diode OLED.

The organic light emitting diode OLED may include a first electrode connected to the third pixel transistor PT3 and a second electrode receiving the second emission power source ELVSS.

When the third pixel transistor PT3 is turned on, a current I flowing from the first pixel transistor PT1 is applied to the organic light emitting diode OLED and then the organic light emitting diode OLED emits the light. An emission period of the organic light emitting diode OLED may be determined corresponding to a turning-on period of the third pixel transistor PT3.

According to the exemplary embodiment, the scan driver 140 may provide the N-type pixel transistor among the plurality of pixel transistors in the pixel with a scan signal S such that the scan signal S may be used as a control signal of the N-type pixel transistor.

According to the exemplary embodiment, the pixel may include three N-type pixel transistors and the scan signal S is applied to the second pixel transistor PT2 as the control signal. However, embodiments of the inventive concept are not limited thereto, and the type and the number of the pixel transistors may be variously set, as appropriate. In addition, the scan signal S may be applied to other pixel transistor except for the second pixel transistor.

Figure 3:
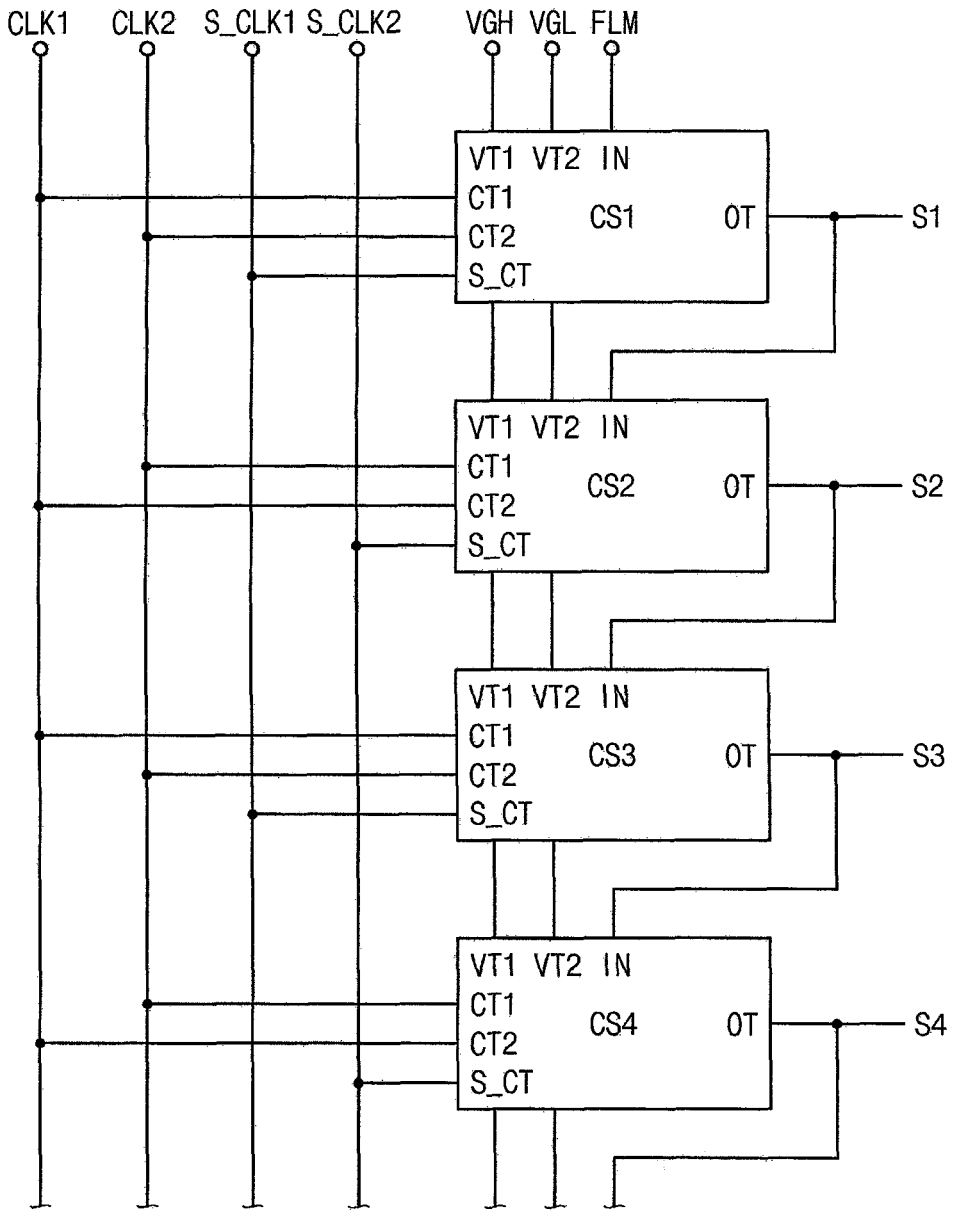
FIG. 3 is a block diagram illustrating a scan driver according to an exemplary embodiment of the inventive concept.
Figure 4:
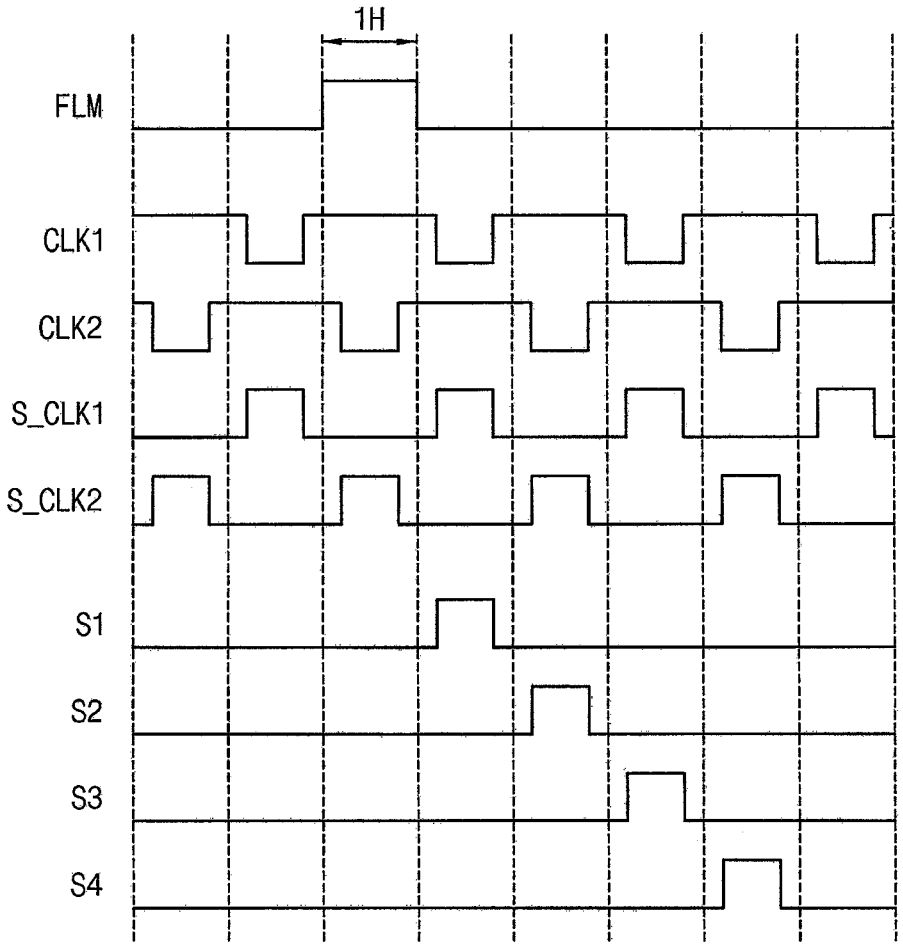
FIG. 4 is a waveform diagram illustrating input and output signals of the scan driver in FIG. 3.

FIG. 3 is a block diagram illustrating a scan driver according to an exemplary embodiment of the inventive concept. FIG. 4 is a waveform diagram illustrating input and output signals of the scan driver in FIG. 3.

Referring to FIGS. 1, 3 and 4, the scan driver 140 may include a plurality of circuit stages CS1, CS2, CS3, and CS4, which sequentially outputs a plurality of scan signals.

The circuit stages CS1, CS2, CS3, and CS4 may be configured to receive a start control signal FLM, a first driving voltage VGL, a second driving voltage VGH, a first clock signal CLK1, a second clock signal CLK2, a first scan clock signal S_CLK1, and a second scan clock signal S_CLK2.

The start control signal FLM may be applied to a first circuit stage CS1 of the circuit stages CS1, CS2, CS3, and CS4.

For example, the first circuit stage CS1 is configured to receive the start control signal FLM, and to output a first scan signal S1 in response to the start control signal FLM. The first scan signal S1 outputted from the first circuit stage CS1 may be applied to a second circuit stage CS2 that is a next stage, as a start control signal. Thus, the second circuit stage CS2 is configured to output a second scan signal S2.

The first driving voltage VGH may have a high voltage H of a high level being higher than a low voltage L of the second driving voltage VGL and the second driving voltage VGL may have a low voltage L being lower than that of the first driving voltage VGH.

The first and second driving voltages VGH and VGL may be commonly applied to the circuit stages CS1, CS2, CS3, and CS4.

The first clock signal CLK1 may have a repetitive period corresponding to two (2) horizontal periods (2H) and a low pulse. For example, the low pulse of the first clock signal CLK1 may control a start period of an odd numbered scan signal outputted from an odd numbered circuit stage among the circuit stages CS1, CS2, CS3, and CS4.

The second clock signal CLK2 may have a repetitive period corresponding to two (2) horizontal periods (2H) delayed from the first clock signal CLK1 and a low pulse. The second clock signal CLK2 may be delayed by 1 horizontal period (1H) from the first clock signal CLK1. For example, the low pulse of the second clock signal CLK2 may control a start period of an even numbered scan signal outputted from an even numbered circuit stage among the circuit stages CS1, CS2, CS3, and CS4.

The first scan clock signal S_CLK1 may have a repetitive period corresponding to two (2) horizontal periods (2H). The first scan clock signal S_CLK1 may be applied to the odd numbered circuit stage and the odd numbered circuit stage may be configured to generate the odd numbered scan signal having a high pulse in synchronization with a high pulse of the first scan clock signal S_CLK1.

The second scan clock signal S_CLK2 may have a repetitive period corresponding to two (2) horizontal periods (2H) and may be delayed from the first scan clock signal S_CLK1. The second scan clock signal S_CLK2 may be applied to the even numbered circuit stage, and the even numbered circuit stage may be configured to generate the even numbered scan signal having a high pulse in synchronization with a high pulse of the second scan clock signal S_CLK2.

The odd numbered stage is configured to output the odd numbered scan signal having a high pulse in synchronization with a high pulse of the first scan clock signal S_CLK1 in a low pulse period of the first clock signal CLK1. The even numbered stage is configured to output the even numbered scan signal having a high pulse in synchronization with a high pulse of the second scan clock signal S_CLK2 in a low pulse period of the second clock signal CLK2.

As described above, the circuit stages CS1, CS2, CS3, and CS4 may be connected to each other in a cascade mode and may be configured to sequentially output first to N-th scan signals S1, S2, S3 and S4 having the high pulse. Each of the first to N-th scan signals S1, S2, S3 and S4 may be used as a control signal of the N-type pixel transistor, which is turned on in response to the high voltage in the pixel.

For example, each circuit stage may include an input terminal IN, a first clock terminal CT1, a second clock terminal CT2, a scan clock terminal S_CT, a first driving voltage terminal VT1, a second driving voltage terminal VT2, and an output terminal OT.

The input terminal IN may be configured to receive a carry signal. According to the exemplary embodiment, the carry signal may have a high pulse corresponding to one (1) horizontal period (1H). The carry signal may be a start control signal FLM or a scan signal outputted from a previous circuit stage.

The first clock terminal CT1 may be configured to receive the first clock signal CLK1 or the second clock signal CLK2 delayed from the first clock signal CLK1.

The second clock terminal CT2 may be configured to receive a different clock signal from a clock signal received through the first clock terminal CT1. For example, when the first clock terminal CT1 is configured to receive the first clock signal CLK1, the second clock terminal CT2 is configured to receive the second clock signal CLK2. In some example embodiments, when the first clock terminal CT1 is configured to receive the second clock signal CLK2, the second clock terminal CT2 is configured to receive the first clock signal CLK1.

For example, the first clock terminal CT1 of the odd numbered circuit stage CS1 is configured to receive the first clock signal CLK1, and the first clock terminal CT1 of the even numbered circuit stage CS2 is configured to receive the second clock signal CLK2. The second clock terminal CT2 of the odd numbered circuit stage CS1 is configured to receive the second clock signal CLK2, and the second clock terminal CT2 of the even numbered circuit stage CS2 is configured to receive the first clock signal CLK1.

The scan clock terminal S_CT is configured to receive the first scan clock signal S_CLK1 or the second scan clock signal S_CLK2 delayed from the first scan clock signal S_CLK1.

For example, the scan clock terminal S_CT of the odd numbered circuit stage CS1 is configured to receive the first scan clock signal S_CLK1, and the scan clock terminal S_CT of the even numbered circuit stage CS2 is configured to receive the second scan clock signal S_CLK2.

The first driving voltage terminal VT1 may be configured to receive a first driving voltage VGH of a high voltage.

The second driving voltage terminal VT2 may be configured to receive a second driving voltage VGL of a low voltage.

The output terminal OT may be configured to output a scan signal. The scan signal may have a high pulse corresponding to one (1) horizontal period (1H).

According to one exemplary embodiment, the odd numbered circuit stage CS1 may be configured to output an odd numbered scan signal S1 having a high pulse in synchronization with a high pulse of the first scan clock signal S_CLK1 and the even numbered circuit stage CS2 may be configured to output an even numbered scan signal S2 having a high pulse in synchronization with a high pulse of the second scan clock signal S_CLK2.

Figure 5:
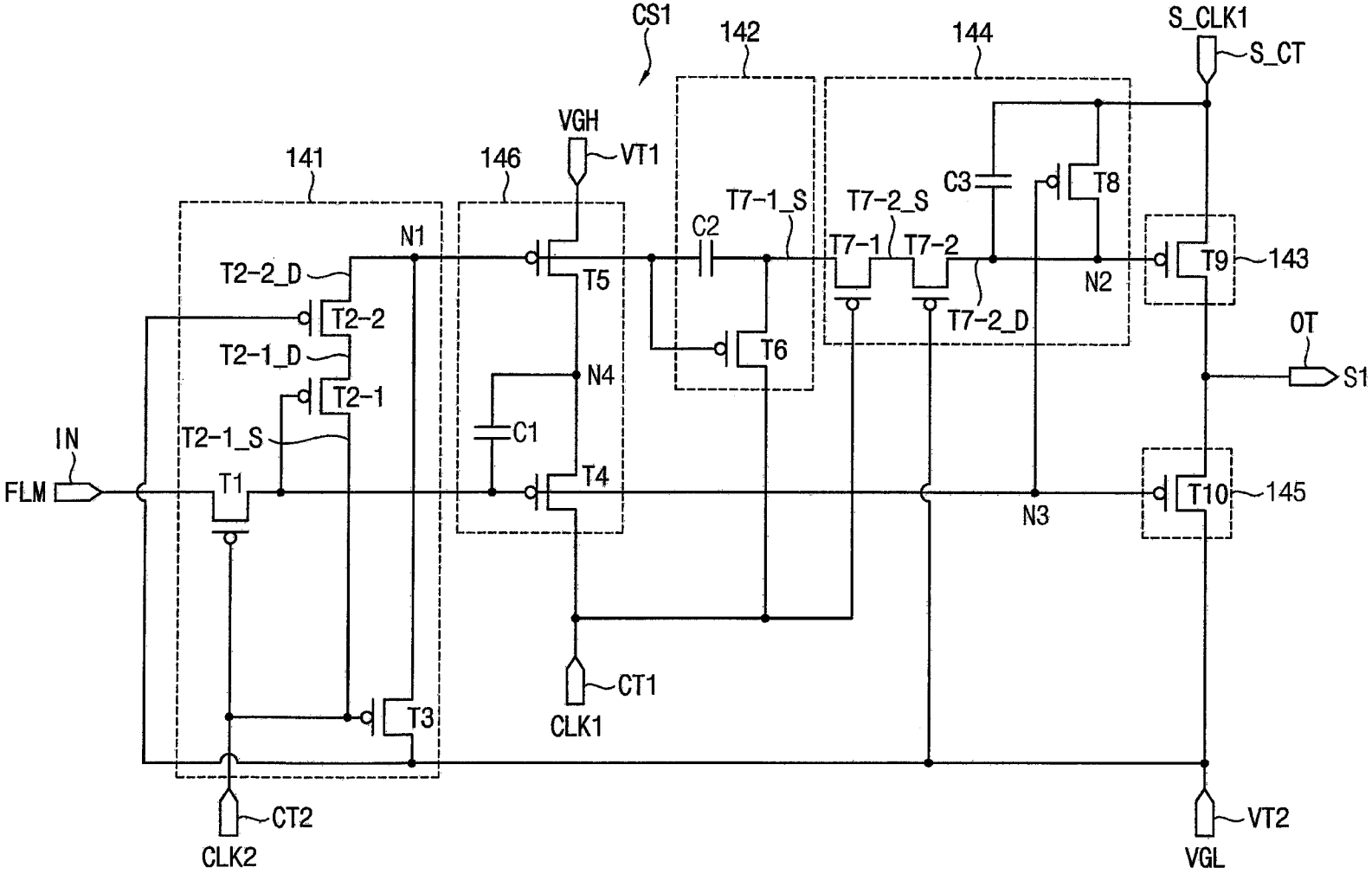
FIG. 5 is a circuit diagram illustrating a first circuit stage in FIG. 3.

FIG. 5 is a circuit diagram illustrating a first circuit stage in FIG. 3.

Hereinafter, each circuit stage of the scan driver may be referred to as a first circuit stage CS1.

Referring to FIGS. 3 and 5, the first circuit stage CS1 may include a signal generating part (e.g., a signal generator) 141, a first node control part (e.g., a first node controller) 142, a pull up/down part (e.g., a pull up/down circuit) 143, a second node control part (e.g., a second node controller) 144, a holding part (e.g., a holding circuit) 145, and a third node control part (e.g., a third node controller) 146.

The signal generating part 141 may be configured to generate a signal of a first node N1 and a signal of a third node N3 based on a start control signal FLM and a second clock signal CLK2. The start control signal FLM may be a carry signal received from the input terminal IN and the second clock signal CLK2 may be received from a second clock terminal CT2.

The signal generating part 141 may include a first transistor T1, a pair of transistors T2-1 and T2-2, and a third transistor T3.

The first transistor T1 may include a control electrode connected to the second clock terminal CT2, a first electrode connected to an input terminal IN, and a second electrode connected to a third node N3.

The (2-1)-th transistor T2-1 may include a control electrode connected to the third node N3, a first electrode T2-1_S connected to the second clock terminal CT2, and a second electrode T2-1_D connected to a first electrode T2-2_S of the (2-2)-th transistor T2-2.

The (2-2)-th transistor T2-2 may include a control electrode connected to a second driving voltage terminal VT2, a first electrode T2-2_S connected to the second electrode T2-1_D of the (2-1)-th transistor T2-1, and a second electrode T2-2_D connected to the first node N1.

The third transistor T3 may include a control electrode connected to the second clock terminal CT2, a first electrode connected to the second driving voltage terminal VT2, and a second electrode connected to the first node N1.

The first node control part 142 is configured to control a signal applied to the first node N1 based on the first clock signal CLK1 received form the first clock terminal CT1.

The first node control part 142 may include a second capacitor C2 and a sixth transistor T6.

The second capacitor C2 may include a first electrode connected to a second electrode of the sixth transistor T6 and a second electrode connected to the first node N1.

The sixth transistor T6 may include a control electrode connected to the first node N1, a first electrode connected to the first clock terminal CT1, and a second electrode connected to a first electrode of a second capacitor C2.

The pull up/down part 143 is configured to output a high voltage of a first scan clock signal S_CLK1 received from the scan clock terminal S_CT as a high voltage of a first scan signal S1 in response to a signal applied to a second node N2. In addition, the pull up/down part 143 may be configured to output a low voltage of the first scan clock signal S_CLK1 received from the scan clock terminal S_CT as a low voltage of the first scan signal S1 in response to a signal applied to a second node N2.

The pull up/down part 143 may include a ninth transistor T9. The ninth transistor T9 may include a control electrode connected to the second node N2, a first electrode connected to the scan clock terminal S_CT, and a second electrode connected to the output terminal OT.

The second node control part 144 is configured to control a signal applied to the second node N2 based on the first clock signal CLK1 received from a first clock terminal CT1 and a signal applied to the third node N3.

The second node control part 144 may include a prior of transistors T7-1 and T7-2, a third capacitor C3 and an eighth transistor T8.

The (7-1)-th transistor T7-1 may include a control electrode connected to the first clock terminal CT1, a first electrode T7-1_S connected to a first electrode of a second capacitor C2, and a second electrode connected to a first electrode T7-2_S of the (7-2)-th transistor T7-2.

The (7-2)-th transistor T7-2 may include a control electrode connected to a second driving voltage terminal VT2, a first electrode T7-2_S connected to the second electrode of the (7-1)-th transistor T7-1, and a second electrode T7-2_D connected to the second node N2.

The third capacitor C3 may include a first electrode connected to the scan clock terminal S_CT and a second electrode connected to the second node N2.

The eighth transistor T8 may include a control electrode connected to the third node N3, a first electrode connected to the scan clock terminal S_CT, and a second electrode connected to the second node N2.

The holding part 145 is configured to hold the first scan signal S1 to a low voltage of the second driving voltage VGL based on a signal applied to the third node N3.

The third node control part 146 is configured to control a signal applied to the third node N3 based on the first clock signal CLK1 received from the first clock terminal CT1.

The third node control part 146 may include a first capacitor C1, a fourth transistor T4 and a fifth transistor T5.

The first capacitor C1 may include a first electrode connected to a fourth node N4 and a second electrode connected to the third node N3.

The fourth transistor T4 may include a control electrode connected to the third node N3, a first electrode connected to the first clock terminal CT1 and a second electrode connected to the fourth node N4.

The fifth transistor T5 may include a control electrode connected to the first node N1, a first electrode connected to the first driving voltage terminal VT1, and a second electrode connected to the fourth node N4.

A DC voltage V_DC may be applied to the control electrodes of the (2-2)-th transistor T2-2 and the (7-2)-th transistor T7-2.

The DC voltage V_DC may have a set or predetermined level, which fully passes a boosting voltage by a bootstrapping capacitor through the (2-2)-th transistor T2-2 such that a corresponding node is charged by the low voltage during a set or predetermined period.

In addition, the drain/source voltages Vds that is distributed to the two serially connected (2-1)-th and (2-2)-th transistors T2-1 and T2-2 can be set a level that is not leaning too much toward one side or the other.

The DC voltage V_DC may be set to various levels according to the first driving voltage VGH, the second driving voltage VGL, and a threshold voltage of the (2-2)-th transistor T2-2.

For example, the DC voltage V_DC may be defined as in the following Equation.

$$VGH-|Vth|<V_DC\leq VGL \quad \text{Equation 1:}$$

As described above, the DC voltage V_DC may be applied to the control electrode of the (7-2)-th transistor T7-2.

Figure 6:
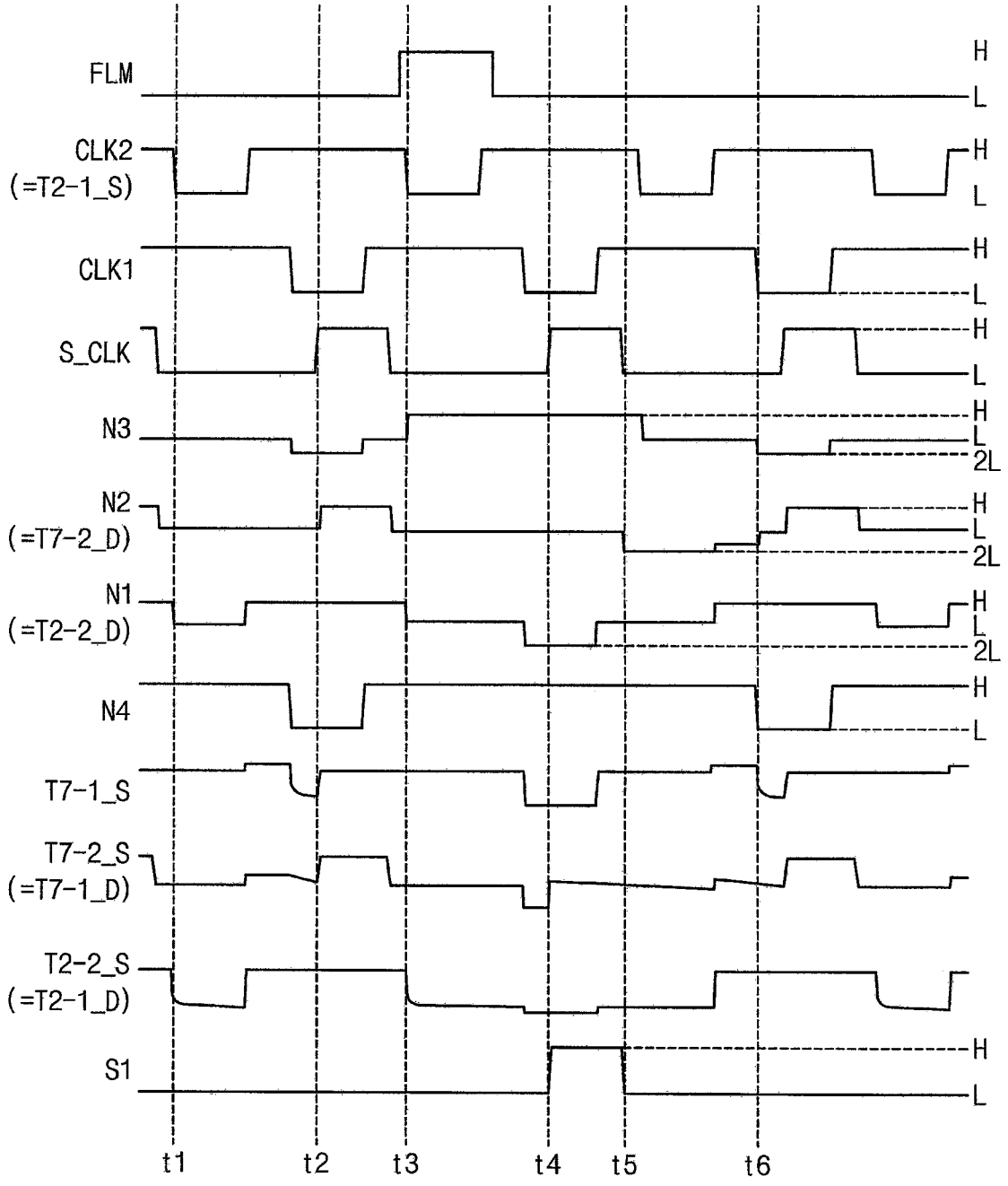
FIG. 6 is a waveform diagram illustrating a method of driving the first circuit stage in FIG. 5.

FIG. 6 is a waveform diagram illustrating a method of driving the first circuit stage in FIG. 5.

Referring to FIGS. 5 and 6, a method of driving the first circuit stage CS1 may be explained. The input terminal IN is configured to receive a start control signal FLM, the first clock terminal CT1 is configured to receive the first clock signal CLK1, the second clock terminal CT2 is configured to receive the second clock signal CLK2, the scan clock terminal S_CT is configured to receive the first scan clock signal S_CLK1 corresponding to the odd numbered stage, a first driving voltage terminal VT1 is configured to receive the high voltage H of the first driving voltage VGH, and a second driving voltage terminal VT2 is configured to receive the low voltage L of the second driving voltage VGL. According to the exemplary embodiment, the start control signal FLM may have a high pulse corresponding to one (1) horizontal period (1H).

During a first period t1, the start control signal FLM may have the low voltage L, the first clock signal CLK1 may have the high voltage H, the second clock signal CLK2 may have the low voltage L and the first scan clock signal S_CLK1 may have the low voltage L.

The first transistor T1 may be turned on in response to the low voltage L of the second clock signal CLK2. The low voltage L of the start control signal FLM may be applied to the control electrode of the (2-1)-th transistor T2-1 and the third node N3 by the turned-on first transistor T1. The third node N3 may have the low voltage L.

The (2-1)-th transistor T2-1 may be turned on in response to the low voltage L of the start control signal FLM and the (2-2)-th transistor T2-2 may be turned on in response to the low voltage L of the second driving voltage VGL. The third transistor T3 may be turned on in response to the low voltage L of the second clock signal CLK2 and may apply the low voltage L of the second driving voltage VGL to the first node N1. Thus, the first node N1 may have the low voltage L.

The sixth transistor T6 may be turned on in response to the low voltage L of the first node N1. Thus, the first electrode of the second capacitor C2 may receive the high voltage H of the first clock signal CLK1 and the second electrode of the second capacitor C2 may receive the low voltage L of the first node N1.

The (7-1)-th transistor T7-1 may be turned off in response to the high voltage H of the first clock signal CLK2, and the (7-2)-th transistor T7-2 may be turned on in response to the low voltage L of the second driving voltage VGL. The eighth transistor T8 may be turned on in response to the low voltage L of the third node N3, and may apply the low voltage L of the first scan clock signal S_CLK1 to the second node N2. The first electrode of the third capacitor C3 connected to the second node N2 may receive the low voltage L of the first scan clock signal S_CLK1 and the second electrode of the third capacitor C3 may maintain the low voltage L, which is previously charged.

The ninth transistor T9 may be turned on in response to the low voltage L of the second node N2 and may apply the low voltage L of the first scan clock signal S_CLK1 to the output terminal OT. Thus, the output terminal OT may output the low voltage L of the first scan signal S1.

The fourth transistor T4 may be turned on in response to the low voltage L of the third node N3, and may apply the high voltage H of the first clock signal CLK1 to the fourth node N4. The fifth transistor T5 may be turned on in response to the low voltage L of the first node N1, and may apply the high voltage H of the first driving voltage VGH to the fourth node N4. The high voltage H of the fourth node N4 may be applied to the first electrode of the first capacitor C1, and the low voltage L of the third node N3 may be applied to the second electrode of the first capacitor C1.

The tenth transistor T10 may be turned on in response to the low voltage L of the third node N3, and may apply the low voltage L of the second driving voltage VGL to the output terminal OT.

Therefore, in the first period t1, the output terminal OT may be configured to output the low voltage L of the first scan signal S1 using the low voltage L of the first scan clock signal S_CLK1 and the low voltage L of the second driving voltage VGL.

During a second period t2, the start control signal FLM may have the low voltage L, the first clock signal CLK1 may have the low voltage L, the second clock signal CLK2 may have the high voltage H and the first scan clock signal S_CLK1 may have the high voltage H.

The first transistor T1 may be turned off in response to the high voltage H of the second clock signal CLK2. The control electrode of the (2-1)-th transistor T2-1 and the third node N3 may maintain the low voltage L of the start control signal FLM, which is previously charged.

The (2-1)-th transistor T2-1 may be turned on and the (2-2)-th transistor T2-2 may be turned on in response to the low voltage L of the second driving voltage VGL. The third transistor T3 may be turned off in response to the high voltage H of the second clock signal CLK2. Thus, the first node N1 may have the high voltage H of the second clock signal CLK2.

The first electrode of the second capacitor C2 may maintain the high voltage H, which is previously charged by turned-off sixth transistor T6, and the second electrode of the second capacitor C2 may receive the high voltage H applied to the first node N1.

The (7-1)-th transistor T7-1 may be turned on in response to the low voltage L of the first clock signal CLK1, and the (7-2)-th transistor T7-2 may be turned on in response to the low voltage L of the second driving voltage VGL. The first electrode of the third capacitor C3 may receive the high voltage H of the first scan clock signal S_CLK1, and second electrode of the third capacitor C3 may receive the high voltage H through the (7-1)-th and (7-2)-th transistors T7-1 and T7-2, which are turned on. The eighth transistor T8 may be turned on in response to the low voltage L of the third node N3 and may apply the high voltage H of the first scan clock signal S_CLK1 to the second node N2.

The ninth transistor T9 may be turned off in response to the high voltage H.

The fourth transistor T4 may be turned on in response to the low voltage L of the third node N3, and may apply the low voltage L of the first clock signal CLK1 to the fourth node N4. The fifth transistor T5 may be turned off in response to the high voltage H of the first node N1.

The first electrode of the first capacitor C1 may have the low voltage L changed from the high voltage H of the fourth node N4. Thus, the second electrode of the first capacitor C1 may be bootstrapped by a voltage difference applied to the first electrode of the first capacitor C1, and thus, the second electrode of the first capacitor C1 may have a boosting voltage 2L lower than the low voltage L. Therefore, the third node N3 may have the boosting voltage 2L.

The tenth transistor T10 may be turned on in response to the low voltage L of the third node N3, and may apply the low voltage L of the second driving voltage VGL to the output terminal OT.

Therefore, in the second period t2, the output terminal OT may be configured to output the low voltage L of the first scan signal S1 using the low voltage L of the second driving voltage VGL.

During a third period t3, the start control signal FLM may have the high voltage H, the first clock signal CLK1 may have the high voltage H, the second clock signal CLK2 may have the low voltage L and the first scan clock signal S_CLK1 may have the low voltage L.

The first transistor T1 may be turned on in response to the low voltage L of the second clock signal CLK2. The high voltage H of the start control signal FLM may be applied to the control electrode of the (2-1)-th transistor T2-1 and the third node N3. The third node N3 may have the high voltage H.

The (2-1)-th transistor T2-1 may be turned off in response to the high voltage H of the start control signal FLM, and the (2-2)-th transistor T2-2 may be turned on in response to the low voltage L of the second driving voltage VGL. The third transistor T3 may be turned on in response to the low voltage L of the second clock signal CLK2 and may apply the low voltage L of the second driving voltage VGL to the first node N1. The first node N1 may have the low voltage L.

The first electrode of the second capacitor C2 may receive the high voltage H of the first clock signal CLK2 by the sixth transistor T6, which is turned on in response to the low voltage L of the first node N1, and the second electrode of the second capacitor C2 may receive the low voltage L of the first node N1.

The (7-1)-th transistor T7-1 may be turned off in response to the high voltage H of the first clock signal CLK1, and the (7-2)-th transistor T7-2 may be turned on in response to the low voltage L of the second driving voltage VGL. The first electrode of the third capacitor C3 may receive the low voltage L of the first scan clock signal S_CLK1, and the second electrode of the third capacitor C3 may maintain the low voltage L, which is previously charged. The second node N2 may have the low voltage L. The eighth transistor T8 may be turned off in response to the high voltage H of the third node N3.

The ninth transistor T9 may be turned on in response to the low voltage L of the second node N2, and may apply the low voltage L of the first scan clock signal S_CLK1 to the output terminal OT. Thus, the output terminal OT may output the low voltage L of the first scan signal S1.

The fourth transistor T4 may be turned off in response to the high voltage H of the third node N3. The fifth transistor T5 may be turned on in response to the low voltage L of the first node N1, and may apply the high voltage H of the first driving voltage VGH to the fourth node N4. The first electrode of the first capacitor C1 may receive the high voltage H.

The tenth transistor T10 may be turned off in response to the high voltage H of the third node N3.

Therefore, in the third period t3, the output terminal OT may be configured to output the low voltage L of the first scan clock signal S_CLK1 as the low voltage L of the first scan signal S1.

During a fourth period t4, the start control signal FLM may have the low voltage L, the first clock signal CLK1 may have the low voltage L, the second clock signal CLK2 may have the high voltage H, and the first scan clock signal S_CLK1 may have the high voltage H.

The first transistor T1 may be turned off in response to the high voltage H of the second clock signal CLK2. The control electrode of (2-1)-th transistor T2-1 and the third node N3 may maintain the high voltage H of the start control signal FLM, which is previously charged.

The (2-1)-th transistor T2-1 may be turned off and the (2-2)-th transistor T2-2 may be turned on in response to the low voltage L of the second driving voltage VGL. The third transistor T3 may be turned off in response to the high voltage H of the second clock signal CLK2. Therefore, the first node N1 may maintain the low voltage L of the second clock signal CLK2, which is previously charged.

The first electrode of the second capacitor C2 may receive the low voltage L of the first clock signal CLK1 by the sixth transistor T6, which is turned on, and the second electrode of the second capacitor C2 may receive the low voltage L of the first node N1.

The first electrode of the second capacitor C2 may have the low voltage L changed from the high voltage H of the first clock signal CLK1. Thus, the second electrode of the second capacitor C2 may be bootstrapped by a voltage difference applied to the first electrode of the second capacitor C2, and thus, the second electrode of the second capacitor C2 may have a boosting voltage 2L lower than the low voltage L Therefore, the first node N1 may have the boosting voltage 2L.

The (7-1)-th transistor T7-1 may be turned on in response to the low voltage L of the first clock signal CLK2, and the (7-2)-th transistor T7-2 may be turned on in response to the low voltage L of the second driving voltage VGL. The first electrode of the third capacitor C3 may receive the high voltage H of the first scan clock signal S_CLK1, and the second electrode of the third capacitor C3 may receive the low voltage L by the (7-1)-th and (7-2)-th transistors T7-1 and T7-2, which are turned on. Therefore, the second node N2 may have the low voltage L. The eighth transistor T8 may be turned off in response to the high voltage H of the third node N3.

The ninth transistor T9 may be turned on in response to the low voltage L of the second node N2.

The fourth transistor T4 may be turned off in response to the high voltage H of the third node N3. The fifth transistor T5 may be turned on in response to the boosting voltage 2L of the first node N1, and the may apply the high voltage H of the first driving voltage VGH to the fourth node N4.

The tenth transistor T10 may be turned off in response to the high voltage H of the third node N3.

Therefore, in the fourth period t4, the output terminal OT may be configured to output the high voltage H of the first scan signal S1 using the high voltage H of the first scan clock signal S_CLK1.

During the fifth period t5, the start control signal FLM may have the low voltage L, the first clock signal CLK1 may have the high voltage H, the second clock signal CLK2 may have the high voltage H, and the first scan clock signal S_CLK1 may have the low voltage L.

The first transistor T1 may be turned off in response to the high voltage H of the second clock signal CLK2. The control electrode of the (2-1)-th transistor T2-1 and the third node N3 may maintain the high voltage H of the start control signal FLM, which is previously charged.

The (2-1)-th transistor T2-1 may be turned off and the (2-2)-th transistor T2-2 may be turned on in response to the low voltage L of the second driving voltage VGL. The third transistor T3 may be turned off in response to the high voltage H of the second clock signal CLK2. Therefore, the first node N1 may maintain the low voltage L of the second clock signal CLK2, which is previously charged.

The first electrode of the second capacitor C2 may receive the high voltage H of the first clock signal CLK1 by the sixth transistor T6, which is turned on. The first electrode of the second capacitor C2 may have the high voltage H changed from the low voltage L of the first clock signal CLK1. Thus, the second electrode of the second capacitor C2 may be bootstrapped by a voltage difference applied to the first electrode of the second capacitor C2, and thus, the second electrode of the second capacitor C2 may have the low voltage L, which is restored from the boosting voltage 2L.

The (7-1)-th transistor T7-1 may be turned off in response to the high voltage H of the first clock signal CLK2, and the (7-2)-th transistor T7-2 may be turned on in response to the low voltage L of the second driving voltage VGL.

The first electrode of the third capacitor C3 may receive the low voltage L of the first scan clock signal S_CLK1, and the second electrode of the third capacitor C3 may maintain the low voltage L, which is previously charged.

The first electrode of the third capacitor C3 may have the low voltage L changed from the high voltage H of the first scan clock signal S_CLK1. Thus, the second electrode of the third capacitor C3 may be bootstrapped by a voltage difference applied to the first electrode of the third capacitor C3, and thus, the second electrode of the third capacitor C3 may have a boosting voltage 2L lower than the low voltage L. Therefore, the second node N2 may have the boosting voltage 2L.

The eighth transistor T8 may be turned off in response to the high voltage H.

The ninth transistor T9 may be turned on in response to the boosting voltage 2L of the second node N2.

The fourth transistor T4 may be turned off in response to the high voltage H of the third node N3. The fifth transistor T5 may be turned on in response to the low voltage L of the first node N1, and may apply the high voltage H of the first driving voltage VGH to the fourth node N4.

The tenth transistor T10 may be turned off in response to the high voltage H of the third node N3.

Therefore, in the fifth period t5, the output terminal OT may be configured to fully output the low voltage L of the first scan clock signal S_CLK1 by the ninth transistor T9, which is turned on in response to the boosting voltage 2L, as the low voltage L of the first scan signal S1.

During a sixth period t6, the start control signal FLM may have the low voltage L, the first clock signal CLK1 may have the low voltage L, the second clock signal CLK2 may have the high voltage H, and the first scan clock signal S_CLK1 may have the low voltage L.

The first transistor T1 may be turned off in response to the high voltage H of the second clock signal CLK2. The control electrode of the (2-1)-th transistor T2-1 and the third node N3 may maintain the low voltage of the start control signal FLM, which is previously charged.

The (2-1)-th transistor T2-1 may be turned on and the (2-2)-th transistor T2-2 may be turned on in response to the low voltage L of the second driving voltage VGL. The third transistor T3 may be turned off in response to the high voltage H of the second clock signal CLK2. Thus, the first node N1 may have the high voltage H of the second clock signal CLK2.

The (7-1)-th transistor T7-1 may be turned on in response to the low voltage L of the first clock signal CLK2, and the (7-2)-th transistor T7-2 may be turned on in response to the low voltage L of the second driving voltage VGL. The eighth transistor T8 may be turned on in response to the low voltage L of the third node N3, and may apply the low voltage L of the first scan clock signal S_CLK1 to the second node N2. The first electrode of the second capacitor C2 may receive the low voltage L of the first scan clock signal S_CLK1 through the (7-1)-th, (7-2)-th and eighth transistors T7-1, T7-2 and T8, which are turned on.

The control electrode of the ninth transistor T9 may receive the low voltage L of the second node N2, and the input of the ninth transistor T9 may receive the low voltage L of the scan clock signal from the scan clock terminal S_CT. Thus, the same low voltage L is applied to the control and the input electrodes of the ninth transistor T9, and thus, the ninth transistor T9 may be turned off.

The fourth transistor T4 may be turned on in response to the low voltage L of the third node N3, and may apply the low voltage L of the first clock signal CLK1 to the fourth node N4. The fifth transistor T5 may be turned off in response to the high voltage H of the first node N1.

The first electrode of the first capacitor C1 may have the low voltage L changed from the high voltage H of the fourth node N4. Thus, the second electrode of the first capacitor C1 may be bootstrapped by a voltage difference applied to the first electrode of the first capacitor C1, and thus, the second electrode of the first capacitor C1 may have a boosting voltage 2L lower than the low voltage L. Therefore, the third node N3 may have the boosting voltage 2L.

The tenth transistor T10 may be turned on in response to the boosting voltage 2L of the third node N3 and the output terminal OT may fully output apply the low voltage L of the second driving voltage VGL.

Therefore, in the second period t2, the output terminal OT may be configured to output the low voltage L of the second driving voltage VGL and the low voltage L of the second driving voltage VGL as the low voltage L of the first scan signal S1.

Figure 7A:
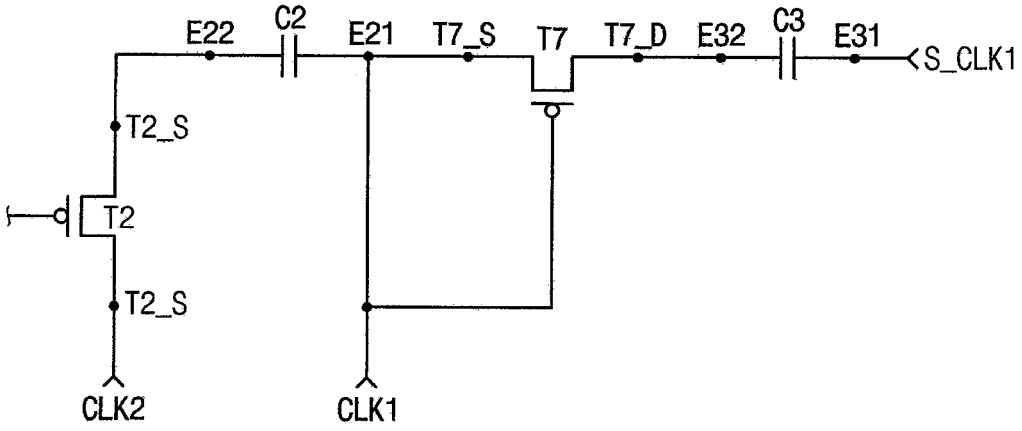
FIGS. 7A-7B are conceptual diagrams illustrating methods of driving the first circuit stage according to a comparative exemplary embodiment of the inventive concept and an exemplary embodiment of the inventive concept, respectively.
Figure 7B:
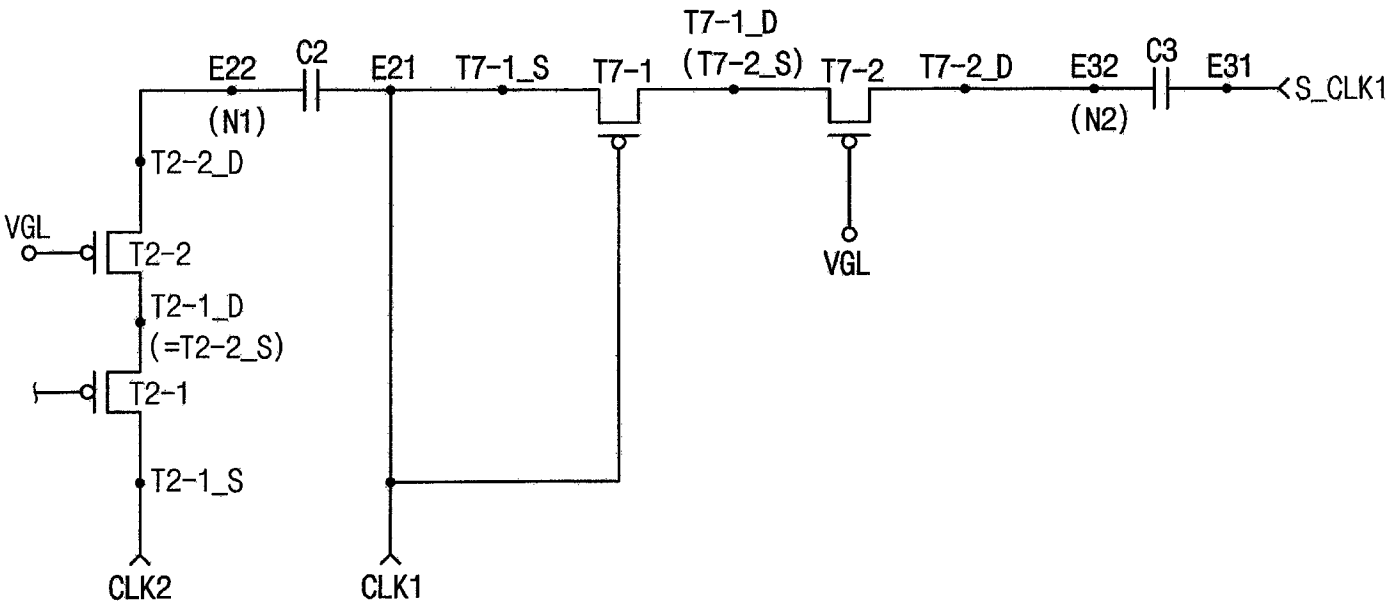

FIGS. 7A and 7B are conceptual diagrams illustrating methods of driving the first circuit stage according to a comparative exemplary embodiment of the inventive concept and an exemplary embodiment of the inventive concept, respectively.

Referring to FIGS. 6 and 7A, according to the comparative exemplary embodiment, a circuit stage may be configured to receive a low voltage L of a start control signal FLM, a low voltage L of a first clock signal CLK1, a high voltage H of a second clock signal CLK2, and a high voltage H of the first scan clock signal S_CLK1 in a fourth period t4.

The second capacitor C2 may be bootstrapped in the fourth period t4. The first electrode E21 of the second capacitor C2 may have the low voltage L changed from the high voltage H of the first clock signal CLK1. Thus, the second electrode E22 of the second capacitor C2 may be bootstrapped by a voltage difference applied to the first electrode E21 of the second capacitor C2, and thus, the second electrode E22 of the second capacitor C2 may have a boosting voltage 2L lower than the low voltage L.

For example, when the low voltage L of a clock signal is about −7 V, the high voltage H of the clock signal may be about 7 V and a boosting voltage 2L is about −20 V, the first electrode T2_S of the second transistor T2 may receive the high voltage H (e.g., about 7 V) of the second clock signal CLK2 and the second electrode T2_D of the second transistor T2 may receive the boosting voltage 2L of about −20 V. A voltage difference Vds between the first and second electrodes T2_S and T2_D of the second transistor T2 may be an absolute value (about 27 V) of about −27 V (=−20 V−7 V).

However, referring to a fifth period t5 according to the comparative exemplary embodiment, the circuit stage may be configured to receive a low voltage L of a start control signal FLM, a high voltage H of a first clock signal CLK1, a high voltage H of a second clock signal CLK2 and a low voltage L of the first scan clock signal S_CLK1 in a fourth period t4.

According to the comparative exemplary embodiment, the third capacitor C3 may be bootstrapped in the fifth period t5. The first electrode E31 of the third capacitor C3 may have the low voltage L changed from the high voltage H of the first scan clock signal S_CLK1. Thus, the second electrode E32 of the third capacitor C3 may be bootstrapped by a voltage difference applied to the first electrode E31 of the third capacitor C3, and thus, the second electrode E32 of the third capacitor C3 may have a boosting voltage 2L lower than the low voltage L.

For example, when the low voltage L of a clock signal is about −7 V, the high voltage H of the clock signal is about 7 V and a boosting voltage 2L may be about −20 V, the first electrode T7_S of a seventh transistor T7 may receive the high voltage H (e.g., about 7 V) of the second clock signal CLK2 and the second electrode T7_D of the seventh transistor T7 may receive the boosting voltage 2L of about −20 V. A voltage difference Vds between the first and second electrodes T7_S and T7_D of the seventh transistor T7 may be an absolute value (about 27 V) of about −27 V (=−20 V−7 V).

According to the comparative exemplary embodiment, the source/drain voltage Vds of the second and seventh transistors T2 and T7 in the circuit stage may increase by the capacitors C2 and C3, which is bootstrapped. Thus, a reliability of the second and seventh transistors T2 and T7 may decrease.

Therefore, according one exemplary embodiment, the circuit stage may include a pair of (2-1)-th and (2-2)-th transistors T2-1 and T2-2 corresponding to the second transistor T2 according to the comparative exemplary embodiment and a pair of (7-1)-th and (7-2)-th transistors T7-1 and T7-2 corresponding to the seventh transistor T7 according to the comparative exemplary embodiment.

Referring to FIGS. 6 and 7B, according to one exemplary embodiment, the circuit stage may be configured to receive a low voltage L of a start control signal FLM, a low voltage L of a first clock signal CLK1, a high voltage H of a second clock signal CLK2 and a high voltage H of the first scan clock signal S_CLK1 in a fourth period t4.

The second capacitor C2 may be bootstrapped in the fourth period t4. The first electrode E21 of the second capacitor C2 may have the low voltage L changed from the high voltage H of the first clock signal CLK1. Thus, the second electrode E22 of the second capacitor C2 may be bootstrapped by a voltage difference applied to the first electrode E21 of the second capacitor C2, and thus, the second electrode E22 of the second capacitor C2 may have a boosting voltage 2L lower than the low voltage L.

For example, when the low voltage L of a clock signal is about −7 V, the high voltage H of the clock signal is about 7 V and a boosting voltage 2L is about −20 V, the first electrode T2-1_S of the (2-1)-th transistor T2-1 may receive the high voltage H (e.g., about 7 V) of the second clock signal CLK2 and the second electrode T2-1_D of the (2-1)-th transistor T2-may receive the low voltage L of the first node N1 by the (2-2)-th transistor T2-2, which is turned on in response to the low voltage L of the second driving voltage VGL. A voltage difference Vds between the first and second electrodes T2-1_S and T2-1_D of the (2-1)-th transistor T2-1 may be an absolute value (about 14 V) of about −14 V (=−7 V−7 V).

The first electrode T2-2_S of the (2-2)-th transistor T2-2 may receive the low voltage L, which is the same as the low voltage L applied to the second electrode T2-1_D of the (2-1)-th transistor T2-1. The second electrode T2-2_D of the (2-2)-th transistor T2-2 may receive the boosting voltage 2L, which is applied to the second electrode E22 of the second capacitor C2. A voltage difference Vds between the first and second electrodes T2-2_S and T2-2_D of the (2-2)-th transistor T2-2 may be an absolute value (about 13 V) of about −13 V (=−20 V−(−7 V)).

However, referring to a fifth period t5, according to one exemplary embodiment, the circuit stage may be configured to receive a low voltage L of a start control signal FLM, a high voltage H of a first clock signal CLK1, a high voltage H of a second clock signal CLK2 and a low voltage L of the first scan clock signal S_CLK1 in a fourth period t4.

According to one exemplary embodiment, the third capacitor C3 may be bootstrapped in the fifth period t5. The first electrode E31 of the third capacitor C3 may have the low voltage L changed from the high voltage H of the first scan clock signal S_CLK1. Thus, the second electrode E32 of the third capacitor C3 may be bootstrapped by a voltage difference applied to the first electrode E31 of the third capacitor C3, and thus, the second electrode E32 of the third capacitor C3 may have a boosting voltage 2L lower than the low voltage L.

For example, when the low voltage L of a clock signal is about −7 V, the high voltage H of the clock signal is about 7 V and a boosting voltage 2L is about −20 V, the first electrode T7-1_S of the (7-1)-th transistor T7-1 may receive the high voltage H (e.g., about 7 V) of the first clock signal CLK1 and the second electrode T7-1_D of the (7-1)-th transistor T7-1 may receive the low voltage L of the second node N2 by the (7-2)-th transistor T7-2, which is turned on in response to the low voltage L of the second driving voltage VGL. A voltage difference Vds between the first and second electrodes T7-1_S and T7-1_D of the (7-1)-th transistor T7-1 may be an absolute value (about 14 V) of about −14 V (=−7 V−7 V)

The first electrode T7-2_S of the (7-2)-th transistor T7-2 may receive the low voltage L being the same as the low voltage L applied to the second electrode T7-1_D of the (7-1)-th transistor T7-1. The second electrode T7-2_D of the (7-2)-th transistor T7-2 may receive the boosting voltage 2L applied to the second electrode E32 of the third capacitor C3. A voltage difference Vds between the first and second electrodes T7-2_S and T7-2_D of the (7-2)-th transistor T7-2 may be an absolute value (about 13 V) of about −13 V (=−20 V−(−7 V)).

According to the exemplary embodiment, the source/drain voltage Vds of the (2-1)-th and (2-2)-th transistors T2-1 and T2-2 may be about 13 V to 14 V and the source/drain voltage Vds of the (7-1)-th and (7-2)-th transistors T7-1 and T7-2 may be about 13 V to 14 V.

According to the exemplary embodiment, the source/drain voltage Vds may decrease in comparison with the source/drain voltage Vds according to the comparative exemplary embodiment, and thus, reliability of the (2-1)-th, (2-2)-th, (7-1)-th and (7-2)-th transistors T2-1, T2-2, T7-1 and T7-2 may be improved.

Figure 8:
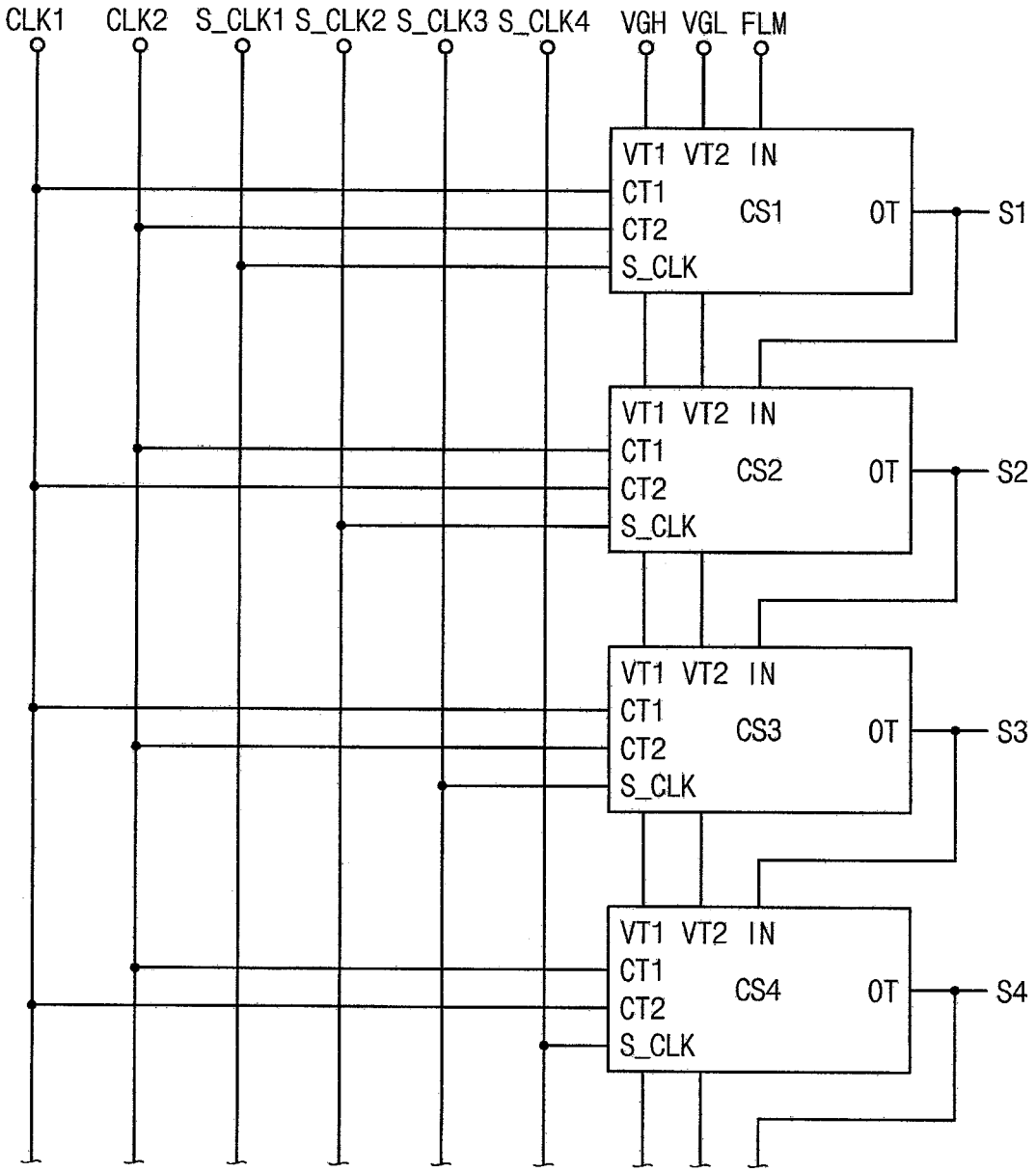
FIG. 8 is a block diagram illustrating a scan according to an exemplary embodiment of the inventive concept.
Figure 9:
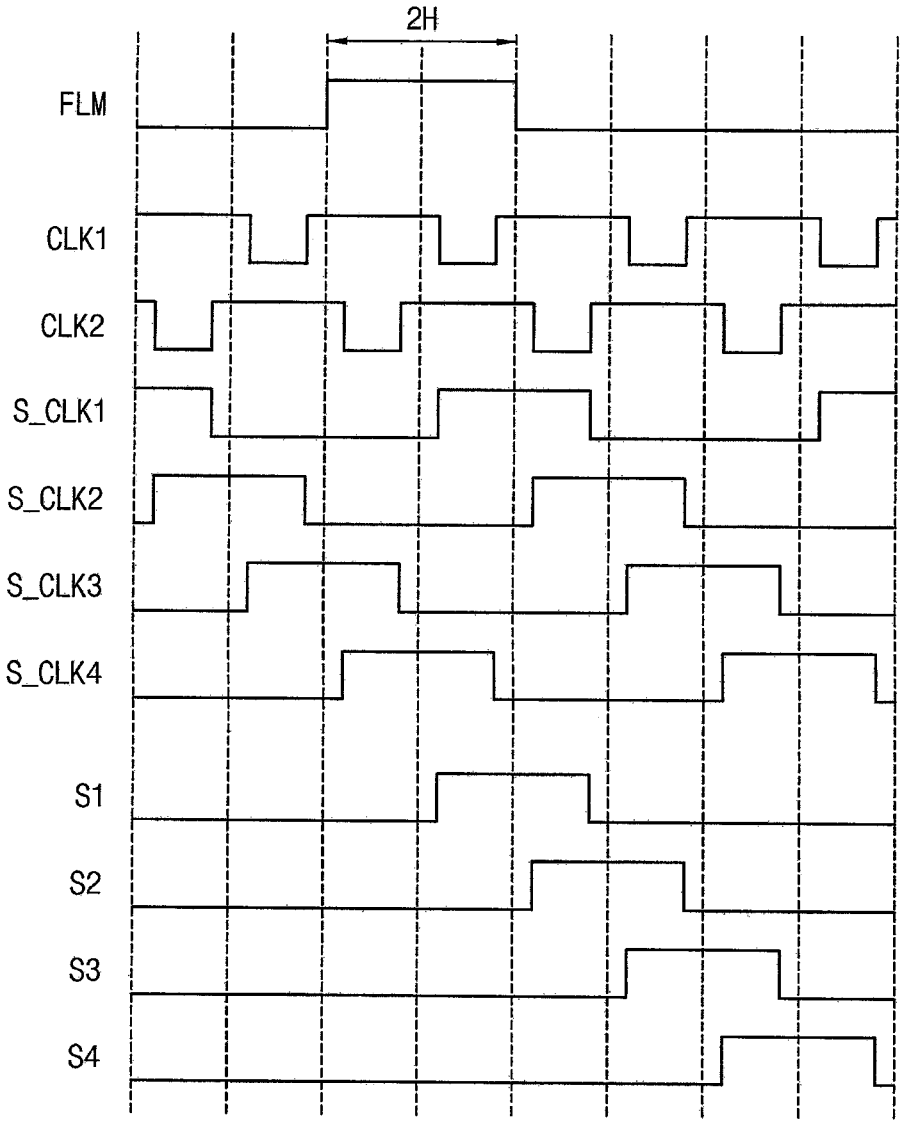
FIG. 9 is a waveform diagram illustrating input and output signals of the scan driver in FIG. 8.
Figure 10:
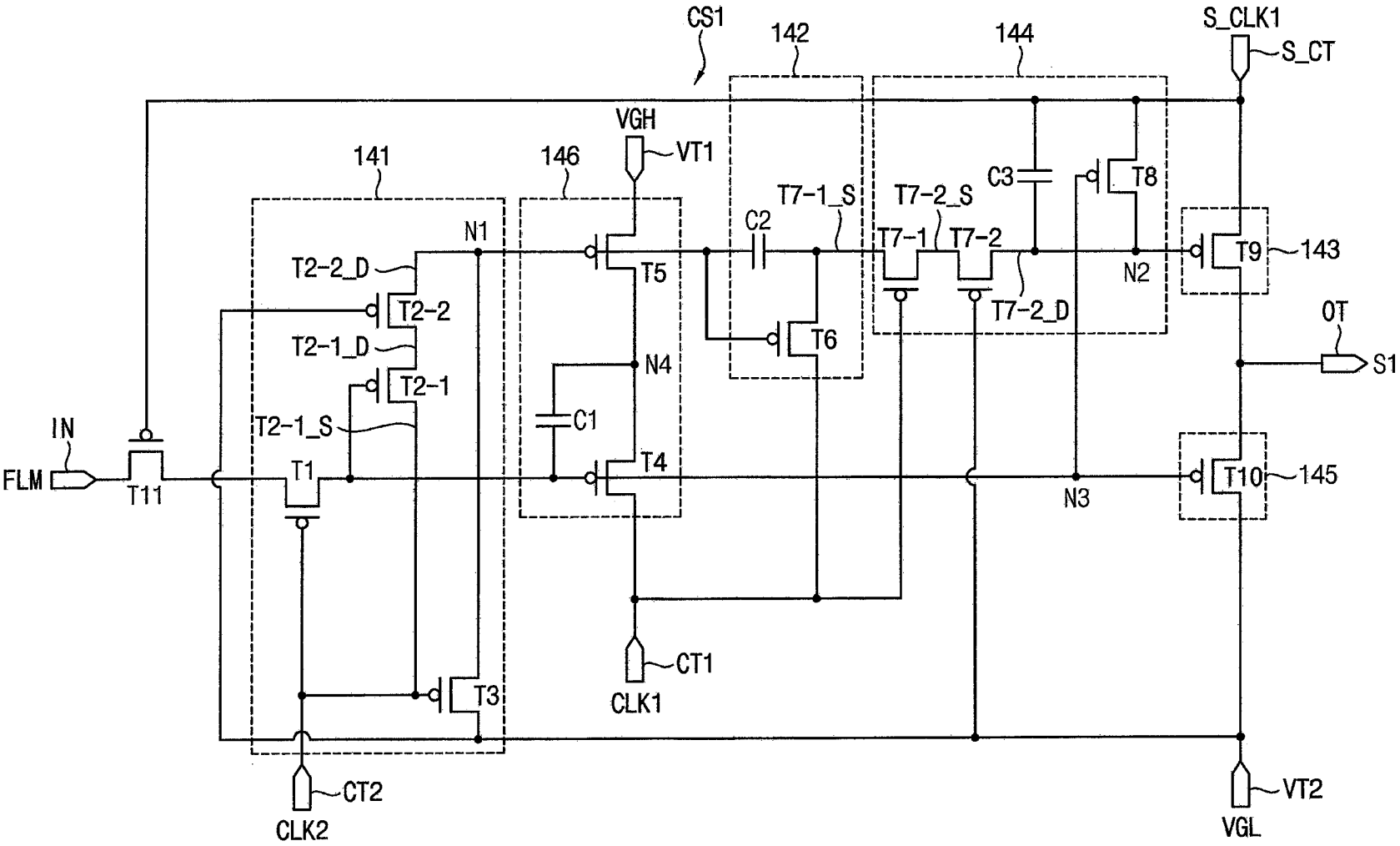
FIG. 10 is a circuit diagram illustrating a first circuit stage in FIG. 8.

FIG. 8 is a block diagram illustrating a scan according to an exemplary embodiment of the inventive concept. FIG. 9 is a waveform diagram illustrating input and output signals of the scan driver in FIG. 8. FIG. 10 is a circuit diagram illustrating a first circuit stage in FIG. 8.

Referring to FIGS. 8 and 9, a circuit stage may include an input terminal IN, a first clock terminal CT1, a second clock terminal CT2, a scan clock terminal S_CT, a first driving voltage terminal VT1, a second driving voltage terminal VT2 and an output terminal OT.

The input terminal IN may be configured to receive a carry signal. According to the exemplary embodiment, the carry signal may have a high pulse corresponding to two (2) horizontal periods (2H). The carry signal may be a start control signal FLM or a scan signal outputted from a previous circuit stage.

The first clock terminal CT1 may be configured to receive the first clock signal CLK1 or the second clock signal CLK2 delayed from the first clock signal CLK1.

The second clock terminal CT2 may be configured to receive a different clock signal from a clock signal received in the first clock terminal CT1. For example, when the first clock terminal CT1 is configured to receive the first clock signal CLK1, the second clock terminal CT2 is configured to receive the second clock signal CLK2. In some examples, when the first clock terminal CT1 is configured to receive the second clock signal CLK2, the second clock terminal CT2 is configured to receive the first clock signal CLK1.

For example, the first clock terminal CT1 of the odd numbered circuit stage CS1 is configured to receive the first clock signal CLK1, and the first clock terminal CT1 of the even numbered circuit stage CS2 is configured to receive the second clock signal CLK2. The second clock terminal CT2 of the odd numbered circuit stage CS1 is configured to receive the second clock signal CLK2, and the second clock terminal CT2 of the even numbered circuit stage CS2 is configured to receive the first clock signal CLK1.

The scan clock terminal S_CT may be configured to receive a first scan clock signal S_CLK1, a second scan clock signal S_CLK2, a third scan clock signal S_CLK3, or a fourth scan clock signal S_CLK4. The second scan clock signal S_CLK2 may be delayed from the first scan clock signal S_CLK1, the third scan clock signal S_CLK3 may be delayed from the second scan clock signal S_CLK2, and the fourth scan clock signal S_CLK4 may be delayed from the third scan clock signal S_CLK3.

For example, the scan clock terminal S_CT of the (4K-3)-th circuit stage CS1 may receive the first scan clock signal S_CLK1, the scan clock terminal S_CT of the (4K-2)-th circuit stage CS2 may receive the second scan clock signal S_CLK2, the scan clock terminal S_CT of the (4K-1)-th circuit stage CS3 CS2 may receive the third scan clock signal S_CLK3, and the scan clock terminal S_CT of the (4K)-th circuit stage CS4 may receive the fourth scan clock signal S_CLK4 (wherein, 'K' is a natural number as 1, 2, 3, . . . )

The first driving voltage terminal VT1 may be configured to receive the high voltage of the first driving voltage VGH.

The second driving voltage terminal VT2 may be configured to receive the low voltage of the second driving voltage VGL.

The output terminal OT may be configured to output the scan signal. The scan signal may have a high pulse corresponding to the 2 horizontal periods (2H).

According to one exemplary embodiment, the (4K-3)-th circuit stage CS1 may be configured to output a (4K-3)-th scan signal S1, which has a high pulse in synchronization with a high pulse of the first scan clock signal S_CLK1; the (4K-2)-th circuit stage CS2, may be configured to output a (4K-2)-th scan signal S2, which has a high pulse in synchronization with a high pulse of the second scan clock signal S_CLK2; a (4K-1)-th circuit stage CS3 may be configured to output a (4K-1)-th scan signal S3, which has a high pulse in synchronization with a high pulse of the third scan clock signal S_CLK3; and a (4K)-th circuit stage CS4, may be configured to output a (4K)-th scan signal S4, which has a high pulse in synchronization with a high pulse of the fourth scan clock signal S_CLK4.

Referring to FIGS. 9 and 10, according to the exemplary embodiment, a first circuit stage may further include an eleventh transistor T11 in comparison with the first circuit stage according to the previous exemplary embodiment as shown in FIG. 5.

The eleventh transistor T11 may include a control electrode connected to the scan clock terminal S_CT, a first electrode connected to the input terminal IN, and a second electrode connected to a first electrode of a first transistor T1.

The eleventh transistor T11 may be configured to provide a carry signal received from the input terminal NI with a first transistor T1 in response to a low voltage of a first scan clock signal S_CLK1 received from the scan clock terminal S_CT.

Remaining transistors except for the eleventh transistor T11 may have the same connections and operations as those of the first circuit stage according to the previous exemplary embodiment shown in FIG. 5, and any repetitive detailed explanation will be omitted.

According to the exemplary embodiments, in the circuit stage, the bootstrapping capacitor is connected to a pair of transistors in series and thus the source/drain voltage of the transistors may decrease and the reliability of the transistors may increase.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, and/or the like.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification.

The scan driver and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the scan driver may be formed on one integrated circuit (IC) chip or on separate IC chips. Further, the various components of the scan driver may be implemented on a flexible printed circuit film, a tape carrier package (TCP), a printed circuit board (PCB), or formed on a same substrate. Further, the various components of the scan driver may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and aspects of the inventive concept. Accordingly, all such modifications are intended to be included within the scope of the inventive concept as defined by the claims and equivalents thereof. In the claims, means-plus-function clauses are intended to cover the structures described herein as performing the recited function and also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A scan driver comprising:

a plurality of circuit stages configured to sequentially output a plurality of scan signals, each one of the plurality of circuit stages comprising:

a signal generator configured to generate signals provided at a first node and a third node based on a carry signal and a second clock signal, the signal generator comprising:

a (2-1)-th transistor comprising a control electrode connected to the third node and a first electrode configured to receive the second clock signal; and a (2-2)-th transistor comprising a control electrode configured to receive a low driving voltage, a first electrode connected to a second electrode of the (2-1)-th transistor, and a second electrode connected to the first node;

a first node controller comprising a second capacitor configured to apply a boosting voltage to the first node based on a first clock signal;

a pull up/down circuit configured to pull the scan signal up to a high voltage and down to a low voltage based on a signal applied to a second node;

a holding circuit configured to hold the scan signal at the low driving voltage based on a signal applied to the third node; and a second node controller configured to apply a first scan clock signal to the second node based on a signal applied to the third node.

2. A scan driver comprising:

a plurality of circuit stages configured to sequentially output a plurality of scan signals, each one of the plurality of circuit stages comprising:

a signal generator configured to generate signals provided at a first node and a third node based on a carry signal and a second clock signal, the signal generator comprising:

a (2-1)-th transistor comprising a control electrode connected to the third node and a first electrode configured to receive the second clock signal; and a (2-2)-th transistor comprising a control electrode configured to receive a low driving voltage, a first electrode connected to a second electrode of the (2-1)-th transistor, and a second electrode connected to the first node;

a first node controller comprising a second capacitor configured to apply a boosting voltage to the first node based on a first clock signal;

a pull up/down circuit configured to pull the scan signal up to a high voltage and down to a low voltage based on a signal applied to a second node a holding circuit configured to hold the scan signal at the low driving voltage based on a signal applied to the third node;

a second node controller configured to control a signal applied to the second node based on the first clock signal and a signal applied to the third node, the second node controller comprising:

a (7-1)-th transistor comprising a control electrode configured to receive the first clock signal;

a (7-2)-th transistor comprising a control electrode configured to receive the low driving voltage, a first electrode connected to a second electrode of the (7-1)-th transistor, and a second electrode connected to the second node; and a third capacitor configured to apply a boosting voltage to the second node.

3. The scan driver of claim 2, further comprising:

a third node controller configured to control a signal applied to the third node and comprising a first capacitor configured to apply a boosting voltage to the third node.

4. The scan driver of claim 3, wherein the signal generator further comprises:

a first transistor comprising a control electrode configured to receive the second clock signal, a first electrode configured to receive the carry signal, and a second electrode connected to the third node; and a third transistor comprising a control electrode configured to receive the second clock signal, a first electrode configured to receive the low driving voltage, and a second electrode connected to the first node.

5. The scan driver of claim 4, wherein the first node controller further comprises a sixth transistor comprising a control electrode connected to the first node and a second electrode of the second capacitor, a first electrode configured to receive the first clock signal, and a second electrode connected to a first electrode of the second capacitor.

6. The scan driver of claim 5, wherein the pull up/down circuit comprises a ninth transistor comprising a control electrode connected to the second node, a first electrode configured to receive a scan clock signal, and a second electrode connected to an output terminal.

7. The scan driver of claim 6, wherein the second node controller further comprises an eighth transistor comprising a control electrode connected to the third node, a first electrode configured to receive a scan clock signal, and a second electrode connected to the second node.

8. The scan driver of claim 7, wherein the holding circuit comprises a tenth transistor comprising a control electrode connected to the third node, a first electrode configured to receive the low driving voltage, and a second electrode connected to the output terminal.

9. The scan driver of claim 8, wherein the third node controller comprises:

a fourth transistor comprising a control electrode connected to the third node and a second electrode of the first capacitor, a first electrode configured to receive the first clock signal, and a second electrode connected to a fourth node; and a fifth transistor comprising a control electrode connected to the first node, a first electrode configured to receive a high driving voltage, and a second electrode connected to the fourth node.

10. The scan driver of claim 9, further comprising:

an eleventh transistor comprising a control electrode configured to receive the scan clock signal, a first electrode configured to receive the carry signal, and a second electrode connected to a first electrode of the first transistor.

11. A display apparatus comprising:

a display panel comprising a plurality of pixels, each one of the plurality of pixels comprising at least one N-type transistor and an organic light emitting diode;

a scan driver configured to provide the N-type transistor with a scan signal and comprising a plurality of circuit stages, each one of the plurality of circuit stages comprising:

a signal generator configured to generate signals provided to a first node and a third node based on a carry signal and a second clock signal, the signal generator comprising:

a (2-1)-th transistor comprising a control electrode connected to the third node and a first electrode configured to receive the second clock signal; and a (2-2)-th transistor comprising a control electrode configured to receive a low driving voltage, a first electrode connected to a second electrode of the (2-1)-th transistor and a second electrode connected to the first node;

a first node controller comprising a second capacitor configured to apply a boosting voltage to the first node based on a first clock signal;

a pull up/down circuit configured to pull the scan signal up to a high voltage and down to a low voltage based on a signal applied to a second node;

a holding circuit configured to hold the scan signal at the low driving voltage based on a signal applied to the third node; and a second node controller configured to apply a first scan clock signal to the second node based on a signal applied to the third node.

12. The display apparatus of claim 11, wherein the second node controller is further configured to control a signal applied to the second node based on the first clock signal and a signal applied to the third node, the second node controller comprising:

a (7-1)-th transistor comprising a control electrode configured to receive the first clock signal;

a (7-2)-th transistor comprising a control electrode configured to receive the low driving voltage, a first electrode connected to a second electrode of the (7-1)-th transistor, and a second electrode connected to the second node; and a third capacitor configured to apply a boosting voltage to the second node.

13. The display apparatus of claim 12, wherein the one of the plurality of circuit stages further comprises:

a third node controller configured to control a signal applied to the third node and comprising a first capacitor configured to apply a boosting voltage to the third node.

14. The display apparatus of claim 13, wherein the signal generator comprises:

a first transistor comprising a control electrode configured to receive the second clock signal, a first electrode configured to receive the carry signal, and a second electrode connected to the third node; and a third transistor comprising a control electrode configured to receive the second clock signal, a first electrode configured to receive the low driving voltage, and a second electrode connected to the first node.

15. The display apparatus of claim 14, wherein the first node controller further comprises:

a sixth transistor comprising a control electrode connected to the first node and a second electrode of the second capacitor, a first electrode configured to receive the first clock signal, and a second electrode connected to a first electrode of the second capacitor.

16. The display apparatus of claim 15, wherein the pull up/down circuit comprises a ninth transistor comprising a control electrode connected to the second node, a first electrode configured to receive a scan clock signal, and a second electrode connected to an output terminal.

17. The display apparatus of claim 16, wherein the second node controller further comprises an eighth transistor comprising a control electrode connected to the third node, a first electrode configured to receive a scan clock signal, and a second electrode connected to the second node.

18. The display apparatus of claim 17, wherein the holding circuit comprises a tenth transistor comprising a control electrode connected to the third node, a first electrode configured to receive the low driving voltage, and a second electrode connected to the output terminal.

19. The display apparatus of claim 18, wherein the third node controller comprises:

a fourth transistor comprising a control electrode connected to the third node and a second electrode of the first capacitor, a first electrode configured to receive the first clock signal, and a second electrode connected to a fourth node; and a fifth transistor comprising a control electrode connected to the first node, a first electrode configured to receive a high driving voltage, and a second electrode connected to the fourth nod.

20. The display apparatus of claim 18, wherein the one of the plurality of circuit stages further comprises:

an eleventh transistor comprising a control electrode configured to receive the scan clock signal, a first electrode configured to receive the carry signal, and a second electrode connected to a first electrode of the first transistor.

* * * * *